US008863640B2

(12) United States Patent
Hill et al.

(10) Patent No.: US 8,863,640 B2
(45) Date of Patent: Oct. 21, 2014

(54) CONTROL SYSTEM FOR A HYDRAULIC COUPLER

(75) Inventors: Ian Hill, County Down (GB); Nick Elwell, County Down (GB)

(73) Assignee: Hill Engineering Limited, Newry, County Down (GB)

( * ) Notice: Subject to any disclaimer, the term of this patent is extended or adjusted under 35 U.S.C. 154(b) by 671 days.

(21) Appl. No.: 12/905,164

(22) Filed: Oct. 15, 2010

(65) Prior Publication Data

US 2011/0088795 A1 Apr. 21, 2011

(30) Foreign Application Priority Data

Oct. 16, 2009 (GB) ..... 0918114.0
Jun. 18, 2010 (GB) ..... 1010266.3

(51) Int. Cl.

| | |
|---|---|
| ***F15B 18/00*** | (2006.01) |
| ***F15B 19/00*** | (2006.01) |
| ***E02F 9/22*** | (2006.01) |
| ***E02F 3/36*** | (2006.01) |

(52) U.S. Cl.

CPC ..... *E02F 9/226* (2013.01); *F15B 2211/6313* (2013.01); *F15B 2211/87* (2013.01); *F15B 19/005* (2013.01); *F15B 2211/6323* (2013.01); *E02F 3/3663* (2013.01)

USPC ..... 91/1

(58) Field of Classification Search

USPC ..... 91/1; 92/5 R; 60/328

See application file for complete search history.

(56) References Cited

U.S. PATENT DOCUMENTS

| | | | | |
|---|---|---|---|---|
| 1,085,964 | A | 2/1914 | Briggs | |
| 2,056,006 | A | 9/1936 | Hodgkins | |
| 2,932,282 | A | 1/1945 | McKinley et al. | |
| 2,366,587 | A | 4/1960 | Armington | |
| 3,414,136 | A * | 12/1968 | Moore et al. | 414/5 |

(Continued)

FOREIGN PATENT DOCUMENTS

| | | |
|---|---|---|
| FR | 978531 | 4/1951 |
| FR | 1146273 | 11/1957 |

(Continued)

OTHER PUBLICATIONS

European Search Report for EP 04008658 mailed Aug. 19, 2004.

(Continued)

*Primary Examiner* — Edward Look
*Assistant Examiner* — Michael Quandt
(74) *Attorney, Agent, or Firm* — Gardner, Linn, Burkhart & Flory, LLP

(57) ABSTRACT

A control system for extending and retracting a ram of a hydraulic coupler for coupling an attachment to an arm of an excavator or back hoe, said control system being adapted to provide an audible and/or visual alert to an operator to indicate a leak of fluid or loss of fluid pressure from said ram and/or from a hydraulic circuit supplying said fluid to the ram. Preferably the control system further comprises a flow sensor for sensing the flow of fluid in a feed line for supplying pressurized fluid to the ram and/or a pressure sensor for sensing the pressure of fluid in said feed line, said control system including at least one indication device for providing said audible and/or visual alert to an operator to indicate a leak of fluid or loss of fluid pressure in response to, or as a function of, the output of the flow sensor and/or the pressure sensor.

6 Claims, 3 Drawing Sheets

(56) References Cited

U.S. PATENT DOCUMENTS

| | | | | | |
|---|---|---|---|---|---|
| 3,940,931 | A * | 3/1976 | Renfro et al. | 60/403 |
| 4,577,885 | A | 3/1986 | Breu | |
| 4,748,570 | A * | 5/1988 | Shochi et al. | 700/175 |
| 5,239,919 | A * | 8/1993 | Maki et al. | 100/35 |
| 5,355,676 | A * | 10/1994 | Inokuchi | 60/413 |
| 5,423,625 | A | 6/1995 | Gebauer et al. | |
| 5,617,771 | A * | 4/1997 | Landrum | 91/1 |
| 5,748,077 | A * | 5/1998 | Brandt | 340/450 |
| 6,132,131 | A | 10/2000 | Nakamura et al. | |
| 6,173,572 | B1 * | 1/2001 | Cobo et al. | 60/327 |
| 6,273,128 | B1 | 8/2001 | Paczonay | |
| 6,286,412 | B1 * | 9/2001 | Manring et al. | 91/433 |
| 6,295,810 | B1 * | 10/2001 | Langen et al. | 60/450 |
| 6,332,747 | B1 | 12/2001 | Lee | |
| 6,379,075 | B1 | 4/2002 | Shamblin et al. | |
| 6,422,805 | B1 | 7/2002 | Miller | |
| 6,481,124 | B1 | 11/2002 | Miller et al. | |
| 6,579,263 | B1 | 6/2003 | Chernack | |
| 6,902,346 | B2 | 6/2005 | Steig, Jr. et al. | |
| 7,018,159 | B2 * | 3/2006 | Jordan et al. | 414/636 |
| 7,047,866 | B2 * | 5/2006 | Fatemi et al. | 91/432 |
| 7,306,395 | B2 | 12/2007 | Fatemi | |
| 7,426,796 | B2 * | 9/2008 | Cunningham et al. | 37/468 |
| 7,493,712 | B2 | 2/2009 | McCormick et al. | |
| 7,549,243 | B1 | 6/2009 | Gilles | |
| 7,620,522 | B2 * | 11/2009 | Bredau et al. | 702/183 |
| 7,648,305 | B2 | 1/2010 | Beales | |
| 7,797,862 | B2 | 9/2010 | Daraie et al. | |
| 7,984,575 | B2 | 7/2011 | Robl et al. | |
| 7,984,576 | B2 | 7/2011 | Miller et al. | |
| 8,136,353 | B2 * | 3/2012 | Dybing | 60/327 |
| 2002/0071754 | A1 | 6/2002 | Fatemi | |
| 2003/0010198 | A1 * | 1/2003 | Fuss et al. | 92/5 R |
| 2004/0255774 | A1 | 12/2004 | Hill | |
| 2005/0169703 | A1 | 8/2005 | Fatemi | |
| 2005/0214105 | A1 | 9/2005 | Steig, Jr. et al. | |
| 2007/0157492 | A1 | 7/2007 | Miller et al. | |
| 2007/0166143 | A1 | 7/2007 | Hart et al. | |
| 2007/0199214 | A1 | 8/2007 | McCormick et al. | |
| 2009/0282712 | A1 | 11/2009 | Pruszynski | |
| 2010/0061799 | A1 | 3/2010 | Hill | |
| 2010/0067982 | A1 | 3/2010 | Hill | |
| 2011/0091267 | A1 | 4/2011 | Hill | |
| 2011/0243654 | A1 | 10/2011 | Hill | |

FOREIGN PATENT DOCUMENTS

| | | | |
|---|---|---|---|
| FR | 2914932 | A1 | 10/2008 |
| GB | 897384 | | 5/1962 |
| GB | 1586621 | | 3/1981 |
| GB | 2330570 | A | 4/1999 |
| GB | 2332417 | A | 6/1999 |
| GB | 2450127 | A | 12/2008 |
| JP | 57155168 | A | 9/1982 |
| KR | 20010019689 | A1 | 3/2001 |
| NZ | 220 557 | A | 2/1991 |
| SE | WO2004072387 | * | 8/2004 |
| WO | WO 98/40569 | A1 | 9/1998 |
| WO | WO 2005/026454 | A1 | 3/2005 |
| WO | WO 2008/031590 | A2 | 3/2008 |
| WO | 2011/035883 | A1 | 3/2011 |

OTHER PUBLICATIONS

International Search Report for PCT Application No. PCT/EP2007/007974, which is the international counterpart to U.S. Appl. No. 12/440,948.

Written Opinion of the International Searching Authority for PCT Application No. PCT/EP2007/007974, which is the international counterpart to U.S. Appl. No. 12/440,948.

European Search Report completed Nov. 20, 2009, which is a foreign counterpart to U.S. Appl. No. 12/555,476.

* cited by examiner

CONTROL SYSTEM FOR A HYDRAULIC COUPLER

FIELD OF THE INVENTION

This invention relates to a control system for a hydraulic coupler for safely and quickly connecting and disconnecting attachments, such as buckets, to the arm of an excavator or backhoe or the like.

BACKGROUND TO THE INVENTION

Hydraulic couplers for quickly connecting and disconnecting attachments, such as buckets, from excavating and construction equipment are well known. By way of example, such attachments are usually attached to an arm of the excavator using two spaced and parallel pins provided on the attachment, wherein one of the pins is generally located in an open-mouthed substantially C-shaped aperture of the coupling and the other pin is located in a similar C-shaped aperture, one or both of the pins being secured within the respective C-shaped aperture by means of a movable jaw or latch member. The C-shaped apertures are arranged such that when the first pin is located in the first aperture and the second pin is secured in the second aperture and the or each latch member is closed the attachment is securely held by the coupling. Typically the or each moveable latch member is moved between an open and a closed position by means of a double acting hydraulic ram operated by a hydraulic control system.

There are many prior art examples of control systems for controlling the operation of such hydraulic couplers, but all have an inherent problem in that a failure of the hydraulic ram supplying primary locking force to the or each latch member can go undetected, possibly causing the attachment to swing or even completely detach from the coupler, posing a serious safety hazard. A similar hazard can occur should the hydraulic pipes supplying the coupler become damaged. The most common area for damage is at the connection between the excavator dipper arm and the coupler. Here the hydraulic hoses are continually flexed and are prone to damage causing premature wear and failure. The failure of a hydraulic hose also leads to the loss of hydraulic oil which also can pollute the environment.

Normally the control system consists of a 4/2 solenoid/spring valve fed with pressurised hydraulic oil from either the excavator main hydraulic line or the excavator servo (reduced pressure) hydraulic line. From the valve two high pressure hydraulic pipes, either flexible or a mixture of flexible and rigid, run from the engine compartment, up the excavator boom, unsupported across the excavator boom to dipper connection, down the dipper arm, unsupported across the excavator dipper to coupler, and terminate at the hydraulic ram within the coupler body. Normally these pipes are split into shorter lengths to facilitate replacement in the event of a failure. In the event of a pipe rupture or an internal failure of the ram the driver has no indication.

OBJECTS OF THE INVENTION

A primary object of the control system for a hydraulic coupler of this invention is to provide a means of informing the operator/driver and/or any other person within the vicinity of the excavator of a loss of the hydraulic clamping force supplied to the coupler resulting in the loss of the main engagement force of the actuating mechanism of the coupler.

The system should preferably be easily tested for its correct function by the operator with self testing incorporated as part of its normal operation.

SUMMARY OF THE INVENTION

According to the present invention there is provided a control system for extending and retracting a ram of a hydraulic coupler for coupling an attachment to an arm of an excavator or back hoe, said control system being adapted to provide an audible and/or visual alert to an operator to indicate a leak of fluid or loss of fluid pressure from said ram and/or from a hydraulic circuit supplying said fluid to the ram.

Preferably said control system includes a flow sensor for sensing the flow of fluid in a feed line for supplying pressurised fluid to the ram and/or a pressure sensor for sensing the pressure of fluid in said feed line, said control system including at least one indication device for providing said audible and/or visual alert to an operator to indicate a leak of fluid or loss of fluid pressure in response to, or as a function of, the output of the flow sensor and/or the pressure sensor.

The control system may include both a flow sensor or switch and a pressure sensor or switch in communication with fluid in the feed line of a hydraulic circuit of the coupler.

Preferably the control system operates the indication device to provide an audible and/or visual signal to the operator in the event of a loss of hydraulic pressure and/or the detection of hydraulic flow when there should be none, as determined by the output of the flow sensor and/or pressure sensor.

In one embodiment, said control system includes an electrical circuit having a power supply for driving said indication device, comprising an audible and/or visual indicator, and at least one switch for activating said indication device, said at least one switch being operatively connected to said flow sensor and/or pressure sensor to selectively supply power from said power supply to said indication device to provide an indication of a loss of hydraulic pressure and/or hydraulic flow when there should be none.

In a preferred embodiment said at least one switch is operatively connected to a pressure sensor, such that the switch is open when the pressure in said feed line exceeds a predetermined pressure. A further switch may be connected in parallel with said at least one switch, said further switch being operatively connected to a flow sensor, such that the switch is open when the flow sensor detects the flow of fluid in the feed line.

The switches may be connected to, or may be provided within, a self contained control box incorporating said indication device which may be activated in the event of a loss of hydraulic pressure and/or hydraulic flow when there should be none. The control box may be mounted in the engine compartment or drivers cab of the excavator.

The control system may be fitted to any excavator with a quick coupler, even those with factory fitted coupler operating switches.

Preferably said control system includes a valve, preferably a solenoid operated valve, for controlling the flow of pressurised fluid to the ram to selectively extend and retract the ram.

Preferably said flow sensor is provided in the hydraulic feed line. Said pressure sensor may be provided in or being connected to an extension line connected to an extension side of the ram for extending the ram when the extension line is connected to the hydraulic feed line via the valve. By the selected placement and type of switches used, a self testing of the operation of the indication system may be carried out as part of the normal operation of the coupler.

In addition, one or more of a non-return valve, a flow restrictor and a pressure reduction valve may be fitted into in the hydraulic feed line for supplying fluid to the valve. This may reduce surges in flow and pressure normally seen in the hydraulic pipes prolonging their life. The pressure reduction valve may be optional and much depends upon the normal working pressure of the hydraulic circuit of the machine as to whether such pressure reduction valve is required.

BRIEF DESCRIPTION OF THE DRAWINGS

An embodiment of the present invention will now be described, by way of example only, with reference to the accompanying drawings, in which.

DETAILED DESCRIPTION OF THE DRAWINGS

Figure 1:
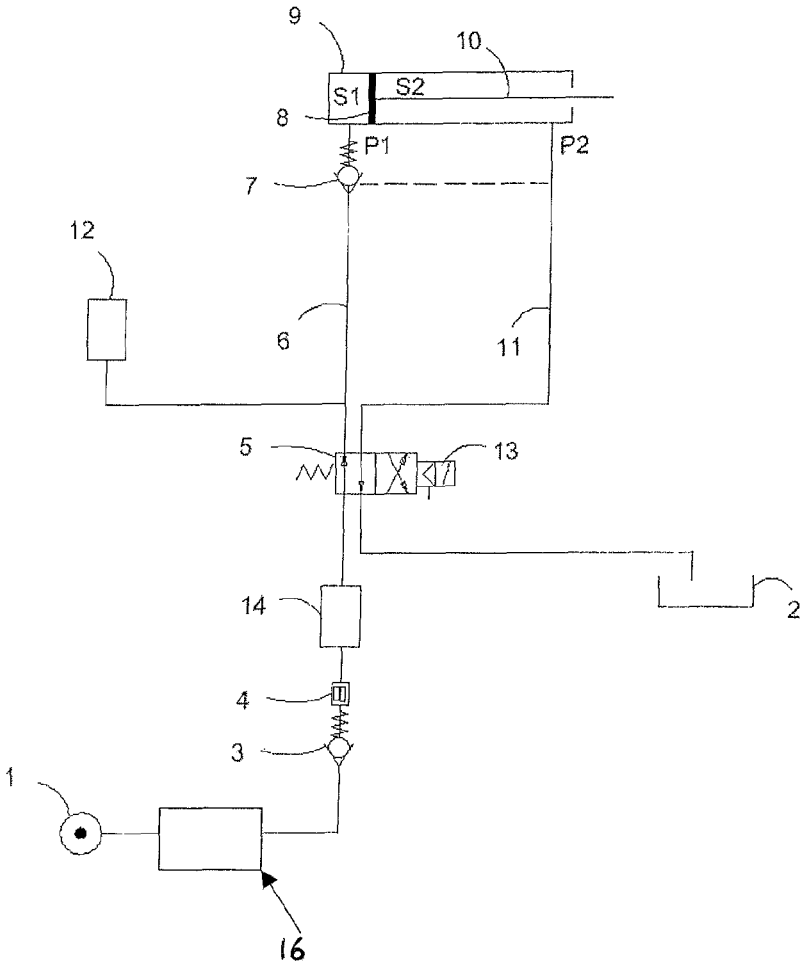
FIG. 1 shows a hydraulic circuit for a coupler control system according to an embodiment of the present invention.

FIG. 1 shows a hydraulic circuit for a hydraulic coupler control system in accordance with an embodiment of the present invention. High pressure oil is supplied to the coupler operating ram 9 by a pump 1. The oil flows though a non-return valve 3, a flow restrictor 4 and a flow switch 14 into an inlet port of a solenoid actuated switching valve 5 driven by a solenoid 13. An optional pressure reducing valve 16 may be provided before the non-return valve 3.

When the solenoid valve 5 is de-energised (as shown in FIG. 1) oil flows through extend line 6 of the ram, through pilot operated check valve 7 and into the extend side S1 of the hydraulic ram 9. This oil flowing through valve 5 causes the flow switch 14 to turn on. This flow of oil into the cylinder via P1 causes the piston 8 of the ram 9 to move, extending the ram. Oil from the opposite side of the piston 8 returns to a tank or reservoir 2 via a retract line 11 via the valve 5. When the piston reaches the end of its stroke, the pressure in the extend line 6 builds up and turns off the pressure switch 12. At the same time the flow switch 14 turns off because the flow through the extend line 6 has reduced to zero.

When the solenoid coil 13 is energised, the switching valve changes over and oil from the pump 1 flows through retract line 11 into the retract side S2 of the hydraulic ram 9. The pressurised oil also opens pilot operated check valve 7 to allow oil from the extend side S1 of the ram 9 to return to the reservoir 2 via the valve 5. The oil flowing through valve 5 causes the flow switch 14 to turn on. This flow of oil into the cylinder via P2 causes piston 8 to move to retract the ram. When the piston reaches the limit of its stroke in the retract direction, the flow switch 14 turns off because the flow has reduced to zero. However, when the cylinder is in the retracted state there is no pressure in the extend line 6 so the pressure switch 12 will remain turned on.

Figure 2:
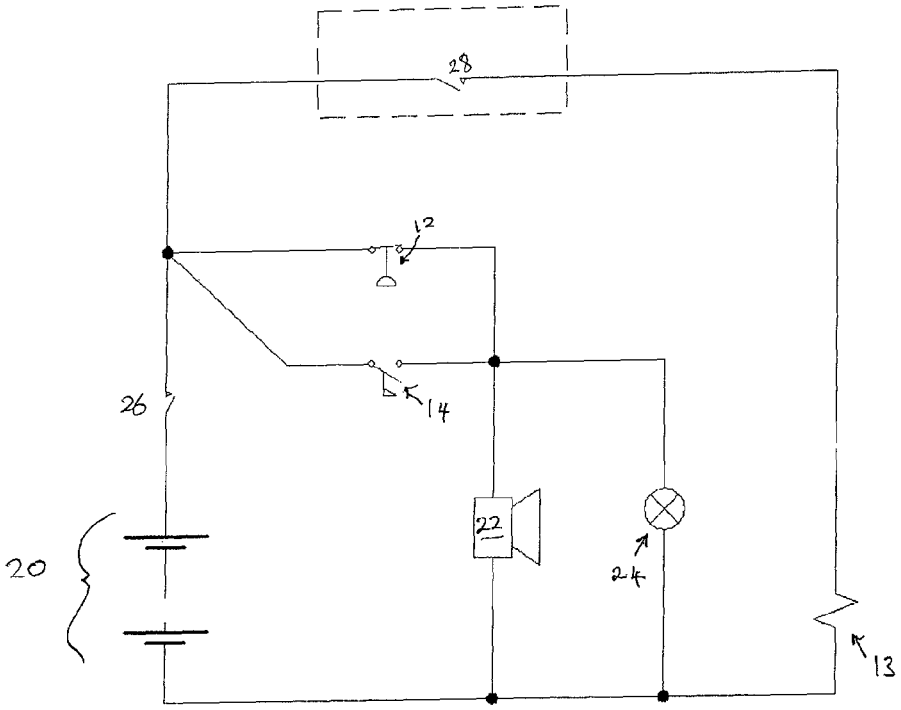
FIG. 2 is an electrical schematic for the control system of FIG. 1.

FIG. 2 illustrates the operator alert components of the control system for providing an indication device to alert the operator to any leakage or failure of the ram, hydraulic flow lines or other components of the hydraulic system. The system comprises a power supply 20, such as a battery, which may be the battery of the excavator or other vehicle to which the control system is fitted, connected to an indication device 22 via an ignition switch 26, comprising a sounder or horn. The indication device 22 may also include a visual indicator 24, such as a light, which may be connected in parallel with the sounder 22. The visual indicator may be provided in addition to or instead of the audio indicator.

If the pressure switch 12 closes due to a loss of hydraulic pressure when the machine ignition 26 is on and the coupler operating switch 28 is in the off position the indication device 22 will activate. This will occur if hydraulic pressure is lost in the extend circuit e.g. while standing overnight or in the case of a supply failure to the hydraulic valve, or a pipe failure.

If the flow switch 14 closes due to flow of oil through the valve 5, the indication device 22 will activate. This will occur normally when the coupler is opened or closed, thus testing the function of both the flow switch 14 and the indication device at every operation. The flow switch 14 will also close, activating the indication device, if unexpected flow occurs in the event of a pipe failure or an internal failure within the ram e.g. a seal failure.

Operation of the Indication Device.

Switch Off, Valve Off, Ram Extended.

In the normal condition with the solenoid 13 de-energised and the ram 9 fully extended, oil will not flow into the ram 9 via extend line 6 as no movement of the ram 9 is taking place. This means that the flow switch 14 is turned off or opened, preventing any flow of electric current through the flow switch. At the same time hydraulic pressure is present in the extend line 6 turning off or opening the pressure switch 12, preventing any flow of electric current through the pressure switch. This means that no current flows through the indication device 22, so it emits no sound.

Switch On, Valve On, Ram Extended.

With the operating switch in the on position, then the solenoid 13 is energised. This causes the valve 5 to change over. As the ram 9 is retracted, oil will flow into the retract side of the ram 9 via retract line 11 and back to the tank from the extend side of the ram 9 via extend line 6 causing the piston rod 10 of the ram 9 to retract. This flow of oil will be sensed by the flow switch 14 which causes the flow switch 14 to turn on or close, permitting the flow of electric current through the flow switch 14. At the same time minimal hydraulic pressure is present in the extend line 6, turning on or closing the pressure switch 12 allowing flow of electric current through the pressure switch 12. This means that current flows through both/either of the flow and pressure switches 12, 14 and through the indication device 22, causing it to emit a sound. In this condition failure of one of either the pressure switch 12 or the flow switch 14 will be undetected as current will flow through the non-failed switch causing the indication device to sound alerting personnel that retraction is taking place.

Switch On, Valve On, Ram Retracted.

With the operating switch in the on position, then the solenoid 13 is energised. This causes the valve 5 to change over. As the ram 9 is fully retracted, oil will no longer flow into the ram via retract line 11. As there is no flow of oil it cause the flow switch 14 to turn off or open, preventing the flow of electric current through the switch. However minimal hydraulic pressure is present in the extend line 6 closing the pressure switch 12 and allowing flow of electric current through the pressure switch 12. This means that current flows through the indication device 22 via the pressure switch 12, so it emits a sound. In this condition a failure of the pressure switch 12 will be detected as no current will flow through the failed pressure switch 12 causing the indication device 22 to silence once retraction has taken place and the flow of oil through the flow switch 14 has ceased.

Switch Off, Valve Off, Ram Retracted.

In this condition with the solenoid 13 de-energised and the ram 9 retracted, oil will flow into the ram 9 via extend line 6 as an extending movement of the ram 9 is taking place. This flow of oil will be detected by the flow switch 14, causing the flow switch 14 to turn on or close, permitting the flow of electric current through the flow switch 14. At the same time hydraulic pressure will be present in the extend line 6 turning off or opening the pressure switch 12 preventing any flow of electric current through the pressure switch 12. This means that current flows through the indication device 22 via the flow switch 14 only, so it will emit a sound. Once the piston rod 10 extension stops then the oil flow into the ram 9 will also stop. This has the action of opening the flow switch 14 causing the indication device to silence once full extension of the ram 9 has taken place.

Switch Off, Valve Off, Ram Extended, Ram Failure.

When the solenoid 13 is de-energised and the ram 9 extended, if there is an internal failure of the ram (e.g. of the ram seals), then oil will flow into the ram via extend line 6, bypass the seals, and will flow back to the tank via retract line 11. This flow of oil will be detected by the flow switch 14, causing the flow switch 14 to turn on or close, permitting the flow of electric current through the switch. However hydraulic pressure may be present in the extend line 6 opening the pressure switch 12, preventing any flow of electric current through the pressure switch 12. This means that current flows through the indication device 22 via the flow switch 14 only, so it will indicate a problem. A total loss of fluid pressure due to a major leak will cause the pressure switch 12 to close allowing current to flow through the pressure switch 12, activating the indication device.

The hydraulic circuit, combined with the addition of the pressure and flow switches in the positions illustrated and the associated electrical controls, thus come together forming a monitoring system for the correct hydraulic coupler operation, which by can be self tested by observing the audible indication from the indication device. It is also easy to integrate a flashing beacon into the indication device to provide an additional visual warning to complement the audible warning if required.

Figure 3:
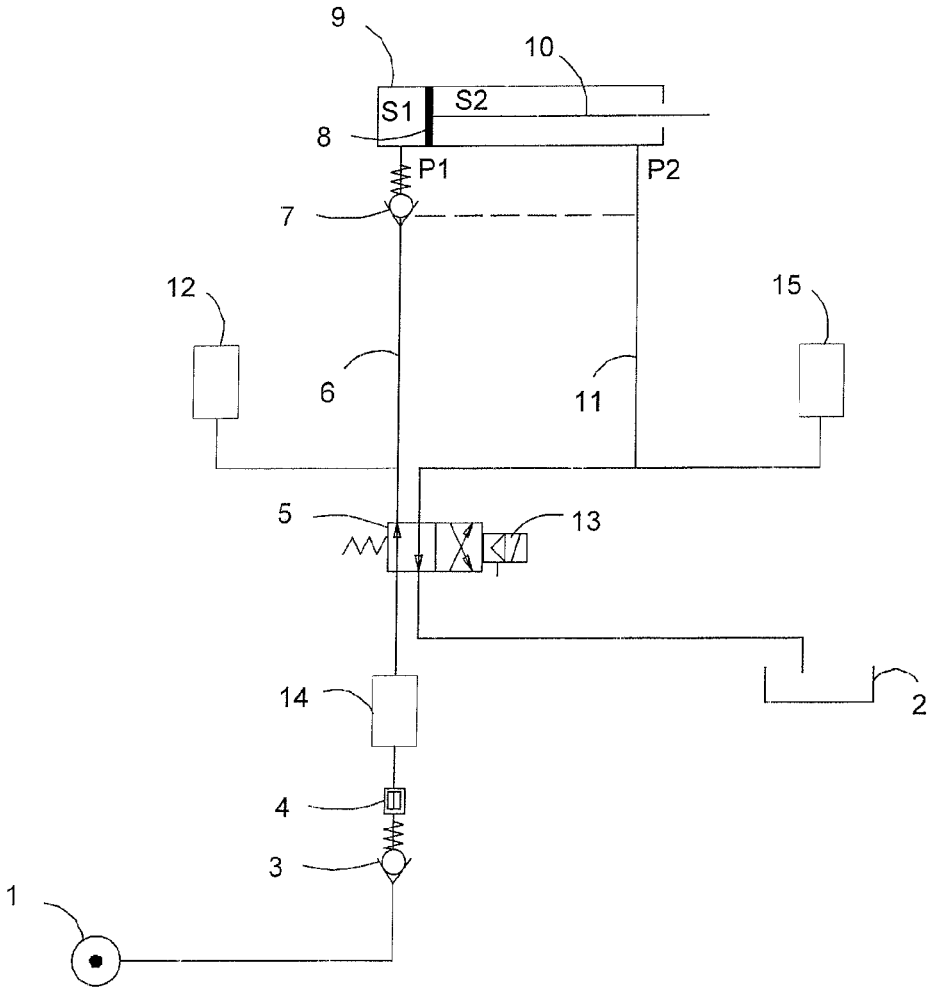
FIG. 3 shows an alternative embodiment of a hydraulic circuit for a coupler control system according to the invention

Referring now to FIG. 3, an alternative embodiment of the control system is illustrated. Save for the addition of a pressure sensor 15, the system of FIG. 3 is the same as the system of FIG. 1 and so like numerals are used to indicate like parts and the same description applies. The pressure sensor 15, conveniently in the form of a pressure switch, is connected to retract line 11 in order to sense fluid pressure in the line 11. The arrangement is such that detection of pressure in line 11 by sensor 15 causes an alarm signal. This is because, during normal operation of the coupler, pressure should not be present in the line 11. In the case where the sensor 15 comprises a switch, the preferred arrangement is such that the switch closes in response to detection of pressure in the line 11 and opens when pressure is not detected. The switch may be incorporated into the circuit of FIG. 2 in parallel with the switches 12, 14. In the preferred embodiment, the pressure sensor 15 detects pressure in line 11 during retraction of the ram 10 and so activates the alarm, thereby allowing the sensor 15 to be tested.

The invention is not limited to the embodiment(s) described herein but can be amended or modified without departing from the scope of the present invention.

The invention claimed is:

1. A control system for extending and retracting a ram of a hydraulic coupler for coupling an attachment to an arm of an excavator or back hoe, said control system including an indication device for providing an audible and/or visual alert to an operator, and an electrical circuit having a power supply for driving said indication device, a first switch comprising a pressure switch communicating with a ram extension line of a hydraulic circuit of the coupler, the first switch opening when the pressure in the ram extension line exceeds a predetermined pressure, and a second switch comprising a flow switch communicating with a feed line of the hydraulic circuit of the coupler, the second switch closing when there is fluid flowing within the feed line, the first and second switches being connected in parallel between the power supply and the indication device to control the supply of power to the indication device whereby the control system operates the indication device to provide an audible and/or visual signal to the operator in the event of a loss of hydraulic pressure as determined by the closing of the first switch and operates the indication device to provide an audible and/or visual signal to the operator in the event of the detection of hydraulic flow when there should be none as determined by the closing of the second switch output of the flow sensor and/or pressure sensor.

2. A control system as claimed in claim 1, wherein the first and second switches are connected to, or are provided within, a self contained control box incorporating said indication device which may be activated in the event of a loss of hydraulic pressure and/or hydraulic flow when there should be none.

3. A control system as claimed in claim 2, wherein the control box is mounted in an engine compartment or a driver's cab of the excavator.

4. A control system as claimed in claim 1, wherein said control system includes a valve for selectively controlling the flow of pressurised fluid to the ram from the feed line to the extension line or retraction line of the ram to selectively extend and retract the ram.

5. A control system as claimed in claim 4, wherein said valve comprises a solenoid operated valve.

6. A control system as claimed in claim 4, wherein one or more of a non-return valve, a flow restrictor and a pressure reduction valve are fitted into in the hydraulic feed line for supplying fluid to the valve.

* * * * *